US009352524B2

(12) United States Patent
De Gaillande

(10) Patent No.: US 9,352,524 B2
(45) Date of Patent: May 31, 2016

(54) STAMPING MACHINE COMPRISING A PLATEN PRESS

(75) Inventor: Christophe De Gaillande, Bussigny (CH)

(73) Assignee: BOBST MEX SA (CN)

( * ) Notice: Subject to any disclaimer, the term of this patent is extended or adjusted under 35 U.S.C. 154(b) by 0 days.

(21) Appl. No.: 13/825,367

(22) PCT Filed: Sep. 21, 2011

(86) PCT No.: PCT/EP2011/004725
§ 371 (c)(1),
(2), (4) Date: Mar. 21, 2013

(87) PCT Pub. No.: WO2012/038079
PCT Pub. Date: Mar. 29, 2012

(65) Prior Publication Data

US 2013/0174749 A1 Jul. 11, 2013

(30) Foreign Application Priority Data

Sep. 22, 2010 (EP) ..... 10010182

(51) Int. Cl.

| | |
|---|---|
| ***B30B 1/14*** | (2006.01) |
| ***B26D 5/16*** | (2006.01) |
| ***B26D 5/18*** | (2006.01) |
| ***B30B 15/00*** | (2006.01) |
| ***B41F 19/06*** | (2006.01) |
| ***B30B 1/26*** | (2006.01) |

(52) U.S. Cl.
CPC . *B30B 15/00* (2013.01); *B26D 5/16* (2013.01); *B26D 5/18* (2013.01); *B30B 1/14* (2013.01); *B30B 1/261* (2013.01); *B41F 19/068* (2013.01); *B41P 2219/132* (2013.01); *B41P 2219/134* (2013.01)

(58) Field of Classification Search
CPC ..... B30B 1/261; B30B 15/00; B30B 1/266; B30B 1/14; B41F 19/068; B41P 2219/132; B41P 2219/134; B26D 5/16; B26D 5/18
USPC ..... 100/281, 282, 286; 72/220, 406, 451, 72/452.4
See application file for complete search history.

(56) References Cited

U.S. PATENT DOCUMENTS

| | | | | |
|---|---|---|---|---|
| 1,558,156 | A | 10/1925 | Ford | |
| 3,046,875 | A | 7/1962 | Bobst | |
| 4,852,382 | A * | 8/1989 | Gietz et al. | 72/406 |
| 5,687,645 | A * | 11/1997 | Kato | 100/282 |
| 5,746,122 | A * | 5/1998 | Gietz et al. | 100/43 |
| 5,979,308 | A * | 11/1999 | Kagi et al. | 101/3.1 |
| 2004/0103799 | A1 | 6/2004 | Liu | |

OTHER PUBLICATIONS

International Search Report dated Oct. 31, 2011 issued in corresponding International patent application No. PCT/EP2011/004725.

* cited by examiner

*Primary Examiner* — Jimmy T Nguyen
(74) *Attorney, Agent, or Firm* — Ostrolenk Faber LLP

(57) ABSTRACT

A stamping machine includes a platen press which has a fixed platen and an opposing moving platen effecting a reciprocating movement imparted by articulated members forming toggle joints. Each articulated member forming a toggle joint including a connecting member which collaborates with a respective cam borne by a camshaft.

6 Claims, 4 Drawing Sheets

STAMPING MACHINE COMPRISING A PLATEN PRESS

CROSS-REFERENCE TO RELATED APPLICATIONS

The present application is a 35 U.S.C. §§371 national phase conversion of PCT/EP2011/004725, filed Sep. 21, 2011, which claims priority of European Application No. 10010182.3, filed Sep. 22, 2010, the contents of which are incorporated by reference herein. The PCT International Application was published in the French language.

BACKGROUND OF THE INVENTION

The present invention relates to a stamping machine comprising a platen press.

It is known practice for texts and/or patterns to be printed by stamping, that is to say by using pressure to apply to a support in sheet form, colored or metalized film taken from one or more stamping strips commonly known as metalized strips. In the industry, such a transfer operation is usually performed using a vertical platen press into which the print supports are introduced, sheet by sheet, while the stamping strips are fed continuously.

In a standard platen press, stamping is performed between a fixed platen running horizontally, and a platen mounted so that it can move in a reciprocating vertical movement. Because this type of press is generally automated, conveyor means are provided to bring each sheet between the platens one by one. In practice, this is usually a series of gripper bars, each of which in turn grasps a sheet at its frontal edge, before pulling it in between the two platens of the press when the latter have been parted sufficiently.

A stamping strip is itself schematically made up of a backing strip of polyester type, to which a pigmented layer is secured by a layer of wax. The external face of this pigmented layer is itself coated with a coat of hot-melt adhesive. As in the case of the sheets, the feed of stamping strips to the press is conventionally automated, but in this instance by means of a drive system capable of unwinding each of said strips and feeding it in a clearly determined feed path which notably passes through the platen press. In general, such a strip drive system combines a series of turn bars which are installed along the entire feed path to guide the progress of the strips, with a number of feed shafts which are positioned downstream of said feed path in order respectively to drive the forward movement of each of said strips.

In industry, stamping is performed on specialist automatic machines. There are different types of machine construction, the most commonplace of which are vertical platen presses which work with a vertical reciprocating movement, cylinder presses and rotary presses.

The invention relates exclusively to the field of machines operating using a platen press. In these machines, the reciprocating movement is imparted to the moving platen by a set of members forming toggle joints and commonly known as toggle joints, collaborating with a drive mechanism of the crankshaft and connecting rod type. When the crankshaft describes a rotary movement, the toggle joints impart a reciprocating movement to the moving platen.

In these machines, the quality of the application depends on a number of parameters. The first is the stamping force. The stamping force is obtained through the vertical movement of the moving platen and the mechanism that moves it, by means of wedge bolts, with respect to a vertical position in which it lies flush with the surface of the fixed platen. A movement through a few tenths of a millimeter is enough to achieve precise adjustment of the stamping force, which may be considerable. Typically, this movement is of between one tenth of a millimeter and less than three millimeters.

The stamping force contributes to the uniform adhesion of the stamping foil to the substrate. If the stamping force is too low, the bond between the substrate and the applied foil will not be sufficiently resistant to scratching. It may even happen that the applied foil fails to adhere to the substrate, or even that there is no foil applied. Conversely, if the stamping force is too high, there is a risk that the stamping will be too deep, with damage to the substrate which may go so far as to tear it by cutting, or damage to the applied foil, or even both. For example, when using metalized strips, the brilliance of the lacquer over the applied foil is frequently lost when the stamping force is too high. Nonetheless, for users of these machines, the stamping force that the machine can tolerate is the most important feature of the machine.

Temperature is another crucial parameter in obtaining a good quality application. The temperature is generally between 90° C. and 130° C. and performs a dual role. Its first role is to soften the layer of wax that connects the layer or layers to be applied (for example a metalized layer and a layer of pigmented lacquer) to the polyester backing strip. The temperature therefore needs to be higher than the melting point of the wax. The second role of the temperature is to activate the adhesive layer that will bond the support and the applied strip together. Various formulations are suited to various supports. For example, for a support made of paper or of cardboard, the adhesive contains polymers compatible with cellulose. For a support made of polypropylene, it will be made up of polymers compatible with polypropylene. The greater the quantity of adhesive, the firmer the adhesive bond. By contrast, a smaller amount of adhesive means that the details of the stamping can be better defined. Too low a temperature will not perform these two functions. Conversely, too high a temperature may burn the strip or render the adhesive too runny and cause it to spill beyond the stamping region, impairing the quality of the periphery of the pattern.

In general, the higher the temperature and the higher the stamping force, the higher the production rate can be.

In order to achieve high production rates, these two parameters have therefore been gradually increased until the limits of the materials used have been reached. Thus, the rate is often limited only by the characteristics of the materials.

The technical problem that the subject of the present invention attempts to solve is that of proposing a stamping machine with a platen press which is able to achieve higher rates than the existing machines. The elements of the invention solve the technical problem. A stamping machine includes a platen press which has a fixed platen and an opposing moving platen effecting a reciprocating movement imparted by articulated members forming toggle joints. Each articulated member forming a toggle joint includes a connecting member which collaborates with a cam borne by a camshaft.

This description, which is given by way of nonlimiting example, is intended to provide a better understanding of the substance of the invention and of how it may be embodied. The description is also given with reference to the attached drawings, in which:

DESCRIPTION OF AN EMBODIMENT

For the sake of clarity, the same elements have been denoted by identical references. Likewise, only elements essential for understanding the invention have been depicted, and then only schematically and not to scale.

Figure 1:
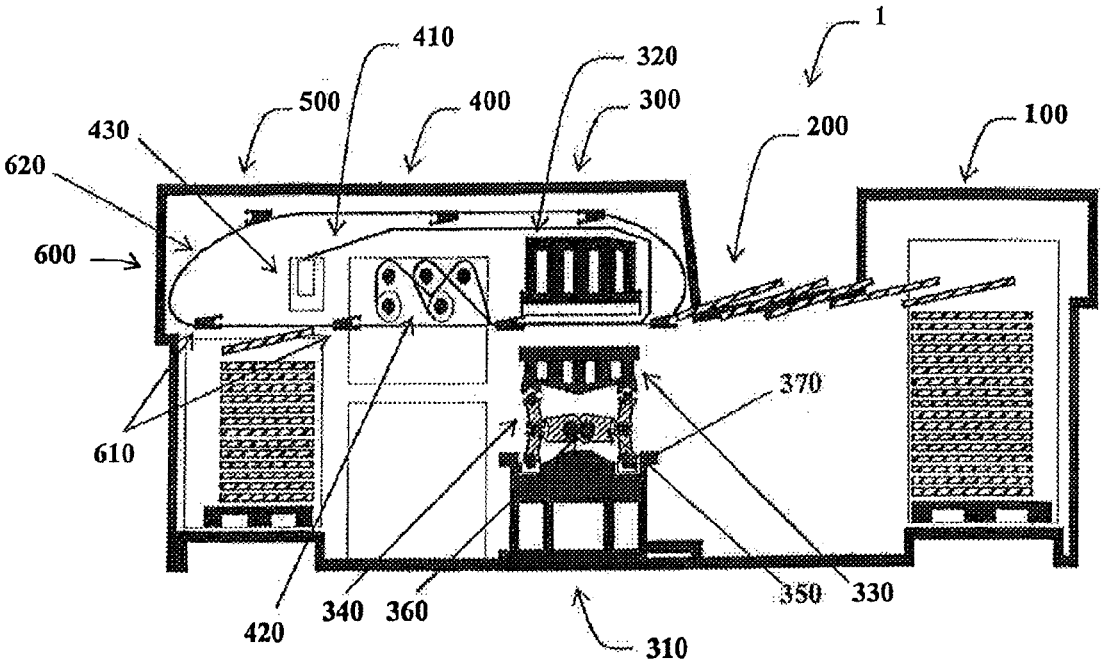
Figure 1 PRIOR ART
FIG. 1 illustrates a stamping machine according to the prior art.

FIG. 1 depicts a stamping machine 1 which is intended for customizing cardboard packaging and may be useful for the luxury goods industry. Commonly known as a gilding machine, this printing machine 1 is conventionally made up of a number of workstations 100, 200, 300, 400, 500 which are juxtaposed with, but interdependent on, one another in order to form a unit assembly capable of processing a succession of supports in sheet form. There is thus a feeder 100, a feed board 200, a stamping station 300, a strip feed and recovery station 400, and a receiving station 500. A conveyor device 600 is also provided, to move each sheet individually from the exit of the feed board 200 to the receiving station 500, including through the stamping station 300.

The various parts 100, 200, 300, 400, 500, 600 of the printing machine 1 are perfectly known from the prior art and will therefore not be described in detail here, either in terms of their structure or in terms of their operation.

It will simply be specified that, in this particular embodiment, chosen solely by way of example, the feeder 100 is fed via a succession of pallets on each of which a plurality of sheets of cardboard are stacked. These sheets are successively taken off the top of the stack by a gripper member which transports them as far as the directly adjacent feed board 200.

At the feed board 200, the sheets are laid out layered by the gripper member, which means that they are laid one after the other with partial overlap. The whole layer is then driven along a platform toward the stamping station 300 by means of a belt-type conveyor mechanism. At the end of the layer, the lead sheet is systematically positioned accurately, for example using front and side lays.

The workstation situated just after the feed board 200 is therefore the stamping station 300. The latter has the function of applying to each sheet, by hot stamping, some film which comes from a stamping strip 410. To do that, it uses a platen press 310 in which the stamping operation is performed in the conventional way, between a heated top platen 320 which is fixed, and a bottom platen 330 which is mounted with the ability to move in a reciprocating vertical movement.

Downstream of the stamping station 300 is the strip feed and recovery station 400. As its name suggests, this station plays a dual role because it has the task both of feeding the machine with stamping strip 410, and of removing this same strip once it is spent.

In this particular embodiment, the strip 410 is stored in the conventional way in wound form, around a feed reel 420 mounted such that it can rotate. After having passed through the platen press 310, the strip 410 is removed by a take-up device 430.

The process of processing the sheets in the printing machine 1 ends at the receiving station 500, the main function of which is to form the already processed sheet back into a stack. To do that, the conveyor device 600 is arranged to release each sheet automatically when this sheet comes back into line with this new stack. The sheet then drops squarely onto the top of the stack.

In a highly conventional way, the conveyor device 600 uses a series of gripper bars 610 which are mounted with transverse translational mobility via two chainsets 620 arranged laterally along each side of the stamping machine 1. Each chainset 620 travels in a loop which allows the gripper bars 610 to follow a trajectory that passes in succession through the stamping station 300, the feed and discharge station 400 and the receiving station 500.

The moving platen 330 is supported by several articulated members forming a toggle joint 340. Each articulated member forming a toggle joint 340 is made up of two segments, one has one end mounted such that it can rotate with respect to the moving platen, the other segment has an end mounted such that it can rotate with respect to a support borne by a wedge bolt. The other two ends of the segments are articulated to one another via a pivot pin about which there is also articulated a connecting rod 350 which is connected to the crankshaft 360.

The wedge bolts 370 are wedge-shaped and capable of translational movement. The movement of a wedge bolt 370 causes a vertical movement of the articulated member forming a toggle joint 340 that it supports, and of the moving platen 330. The stamping force is adjusted accurately using these wedge bolts 370.

Figure 2A:
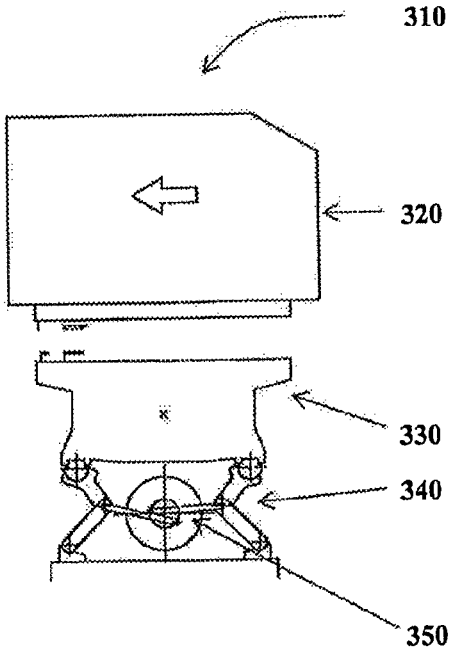
Figure 2a PRIOR ART
FIGS. 2*a* and 2*b* illustrate the operation of the crankshaft and connecting rod system of the machine according to the prior art.
Figure 2B:
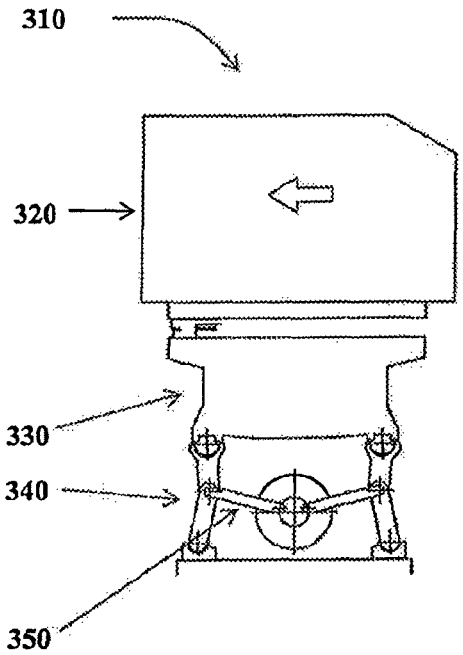
Figure 2b PRIOR ART

FIGS. 2*a* and 2*b* depict in greater detail the principle of operation of the mechanism that imparts the reciprocating movement to the moving platen 330 in the platen press 310 of a stamping machine according to the prior art. FIG. 2*a* depicts the position of the articulated members forming a toggle joint 340 and of the connecting rods 350 when the moving platen 330 is in the lowered position. FIG. 2*b* depicts the position of these same members when the moving platen 330 is in the raised position.

Figure 3A:
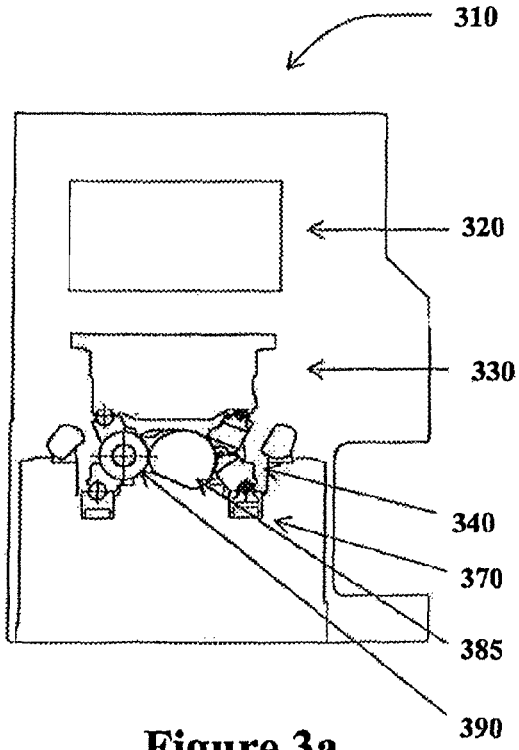
FIGS. 3*a* and 3*b* depict the platen press of a machine according to the invention.
Figure 3B:
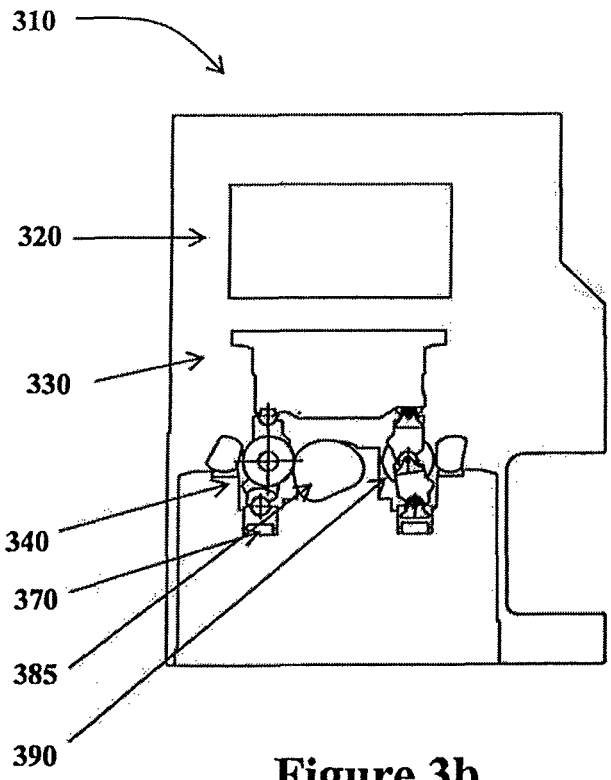

In a similar way to FIGS. 2*a* and 2*b*, FIGS. 3*a* and 3*b* depict the principle of operation of the mechanism that imparts the reciprocating movement to the moving platen 330 in the platen press 310 of a stamping machine according to the invention. FIG. 3*a* depicts the position of the articulated members forming a toggle joint 340 when the moving platen 330 is in the lowered position. FIG. 3*b* depicts the position of these same members when the moving platen 330 is in the raised position.

The stamping machine according to the invention has no crankshaft and no connecting rods as contained in the stamping machine according to the prior art. By contrast, it does have a camshaft 380 bearing at least one cam 385 per articulated member forming a toggle joint 340.

According to the conventional definition, a cam 385 is a mechanical member which imparts a movement in synchrony with the rotational movement of the camshaft 380 that bears it. The cam 385 is, in the conventional way, a cylinder of variable radius ranging between a minimum radius and a maximum radius, and the movement imparted is defined by its exterior profile.

According to the invention, each articulated member forming a toggle joint 340 comprises a connecting member 390 which collaborates with a cam 385 borne by the camshaft 380. By following the exterior profile of the cam 385, the connecting member 390 will impart the movement corresponding to this exterior profile, and the articulated member forming a toggle joint 340 will impart a reciprocating movement to the moving platen 330.

Figure 4:
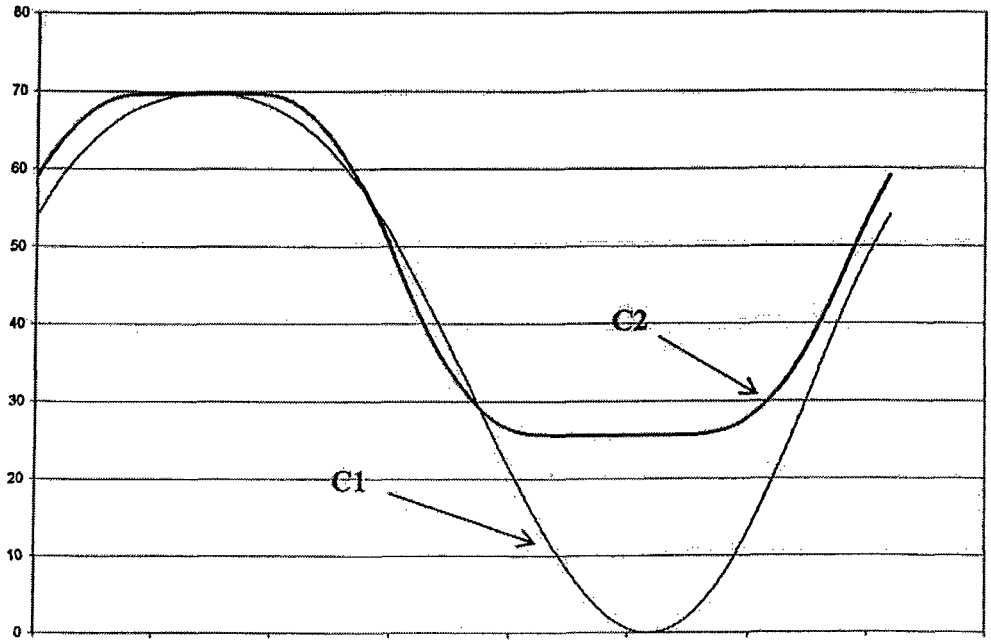
FIG. 4 compares the curves of the vertical positions of the moving platens of a machine according to the prior art and of a machine according to the invention.

In order better to emphasize the difference between the operation of a machine according to the invention and that of a machine according to the prior art, FIG. 4 depicts the curve of the positions occupied by the moving platen 330 during a reciprocating movement which also corresponds to a machine cycle, for a machine according to the prior art which is curve C1 and for a machine according to the invention which is curve C2. The curves C1 and C2 in FIG. 4 correspond to the positions of the platen when there is no contact with the fixed platen 320 but the work surfaces are simply flush with one another. In both instances, the stamping force is zero. This position flush with the fixed platen occurs in the upper parts of the two curves C1 and C2.

In both instances, in order to apply a stamping force, the wedge bolts 370 will need to be moved. It will be immediately appreciated that, in the machines according to the prior art, the stamping force obtained will not be constant, and that the greater the stamping force, the less constant it will be. This is so true that when the rate increases, and a very high stamping force needs to be applied, two phenomena occur: the stamping force is very high for a relatively short period of time, and the moving platen 330 comes into contact with the fixed platen 320 at a high speed. There is therefore the risk that the impact will damage the materials, as will the maximum stamping force.

By contrast, it will be immediately noted from FIG. 4 that, in a machine according to the invention, the stamping force will be practically constant throughout the period of contact between the moving platen 320 and the fixed platen 330.

Now, contrary to the preconceived ideas held by users of stamping machines, it is far more effective to apply a lower stamping pressure over a relatively long period of time than to apply a very high stamping force over a very short period of time. Therefore the machines according to the invention can operate at high work rates, by applying a far lower stamping force.

According to experimental results, for a given job of work, the stamping force is between 20% and 50%, with a mean in excess of 35% less than the maximum stamping force applied by a machine according to the prior art. By contrast, only 7% of the work can be performed using a machine according to the prior art, whereas the proportion rises to over 90% with a machine according to the invention. Further, for a given job of work, the rate is increased by between 10% and over 65%, with a mean of around 40%. The importance of the invention can be measured in terms of the increase in productivity of the machines.

Moreover, FIG. 4 reveals another advantage afforded by the invention. In the machines according to the prior art, the moving platen 330 moves a great distance when it moves away from the fixed platen 320. As a result, the moving platen 330 requires more empty space in which to effect its reciprocating movement, and, what is more, because of this great movement, a great deal of turbulence is created at high production rates and this turbulence may disturb the behavior of the sheet-form elements and of the stamping strips. By contrast, the smaller movements performed by the moving platen 330 of a machine according to the invention allow a marked reduction in this turbulence at very high production rates.

Figure 5:
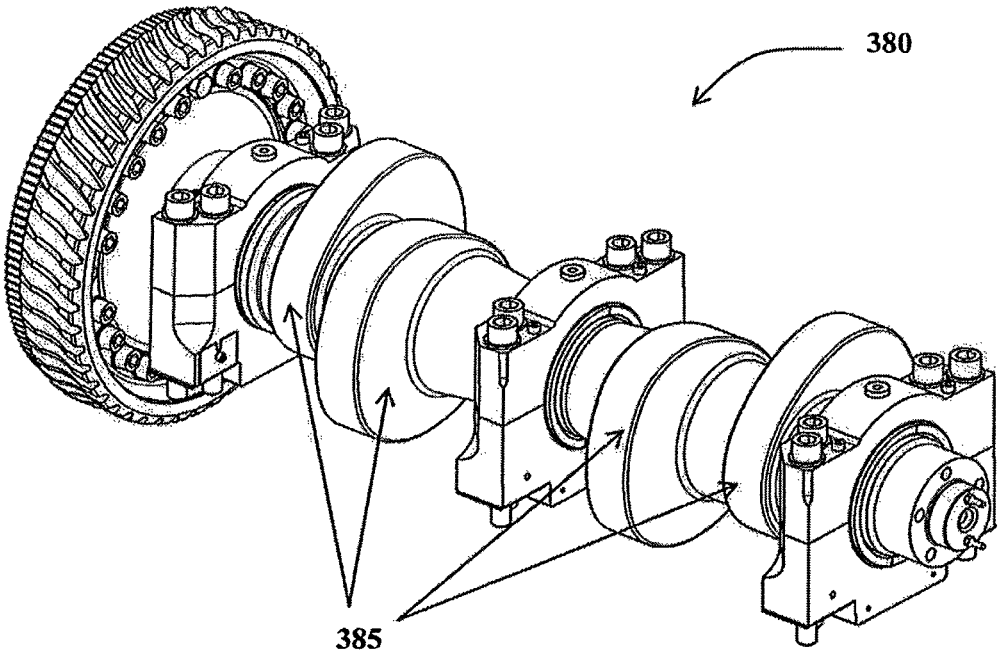
FIG. 5 depicts an example of a cam of a machine according to the invention.

For preference, a machine according to the invention comprises four articulated members forming a toggle joint 340. FIG. 5 depicts a camshaft 380 suited to this preferred embodiment, with four cams 385 forming two pairs, which are intended to collaborate with the four connecting members 390 of the four articulated members forming a toggle joint 340.

Advantageously, each cam 385 comprises a sector of a radius substantially equal to the maximum radius of the cam. The maximum radius of the cam corresponds to the most fully extended position of the articulated members forming toggle joints 340, and therefore to the highest stamping force. This sector therefore makes it possible to have a stamping force that is substantially constant. For preference, this sector is at least 25° which means that the applied stamping force can be reduced, by providing a long application time.

Of course, the invention relates to any stamping machine 1 comprising a platen press 310. While examples have been given by way of illustration, they do not limit the scope of the invention. In particular, the moving platen 330 could just as well be the top platen and the fixed platen 320 the bottom platen. Likewise, the platens need not necessarily be positioned horizontally, etc.

The invention claimed is:

1. A stamping machine for stamping a stamping strip on a support in sheet form comprising:

a platen press comprising a fixed platen and a moving platen opposing each other, the moving platen effecting a reciprocating movement perpendicular to the plane of the platens when the platens are stamping, to provide a period of contact between the platens, wherein a stamping force between said platens is substantially constant throughout said period of contact;

at least two articulated members forming toggle joints for imparting the reciprocating movement to the moving platen; and a rotatable camshaft bearing at least one cam per articulated member which forms one of the toggle joints, each articulated member forming a toggle joint comprising a connecting member collaborating with one of the cams borne by the camshaft, by the cam having a cam surface shaped for moving the collaborating articulated member to reciprocate the moving platen;

wherein each cam comprises a sector having a radius substantially equal to the maximum radius of the cam, and wherein the sector extends at least 25° around the cam.

2. A stamping machine according to claim 1, further comprising four articulated members forming toggle joints.

3. A stamping machine according to claim 1, wherein said reciprocating movement is vertical and moves the moving platen to lie flush with the surface of the fixed platen.

4. A stamping machine for stamping a stamping strip on a support in sheet form comprising:

a platen press comprising a fixed platen and a moving platen opposing each other, the moving platen effecting a reciprocating movement perpendicular to the plane of the platens when the platens are stamping;

at least two articulated members forming toggle joints for imparting the reciprocating movement to the moving platen; and a rotatable camshaft bearing at least one cam per articulated member which forms one of the toggle joints, each articulated member forming a toggle joint comprising a connecting member collaborating with one of the cams borne by the camshaft, by the cam having a cam surface shaped for moving the collaborating articulated member to reciprocate the moving platen;

wherein each cam comprises a sector having a radius substantially equal to the maximum radius of the cam, wherein the sector extends at least 25° around the cam; and wherein said reciprocating movement is vertical and moves the moving platen to lie flush with the surface of the fixed platen.

5. A stamping machine according to claim 4, wherein each said connecting member collaborates with the corresponding one of the cams via a single cam follower.

6. A stamping machine according to claim 1, wherein each said connecting member collaborates with the corresponding one of the cams via a single cam follower.

* * * * *